United States Patent [19]

Rigsby

[11] 4,052,059

[45] Oct. 4, 1977

[54] HOCKEY STICK WITH ADJUSTABLE KNOB

[76] Inventor: Randle L. Rigsby, Rte. No. 1, Box 155, Signal Mountain, Tenn. 37377

[21] Appl. No.: 582,446

[22] Filed: May 30, 1975

[51] Int. Cl.[2] ..... A63B 59/14

[52] U.S. Cl. ..... 273/67 A; 273/165

[58] Field of Search ..... 273/67 A, 72 R, 73 J, 273/75, 81 R, 81 B, 81.3, 81.4, 81.2, 165

[56] References Cited

U.S. PATENT DOCUMENTS

| | | | |
|---|---|---|---|
| 2,321,773 | 6/1943 | Ruemelin | 273/81.2 |
| 2,962,288 | 11/1960 | Lowden | 273/165 |
| 3,341,203 | 9/1967 | Brill | 273/81.3 |
| 3,376,038 | 4/1968 | Henry | 273/81 R |
| 3,469,839 | 9/1969 | Pietronuto et al. | 273/72 R X |
| 3,521,883 | 7/1970 | Hamilton | 273/72 R |
| 3,623,724 | 11/1971 | Lande | 273/72 R |
| 3,940,134 | 2/1976 | Bieganowski | 273/67 A |

FOREIGN PATENT DOCUMENTS

| | | | |
|---|---|---|---|
| 17,166 | 7/1897 | United Kingdom | 273/72 R |

*Primary Examiner*—Richard J. Apley

[57] ABSTRACT

A hockey stick accessory comprising a knob of generally spherical shape and which is mountable along any selected portion of hockey stick handle portion so to give an improved grip to the hands of a hockey player when swinging the hockey stick.

1 Claim, 4 Drawing Figures

Fig. 3
Fig. 4
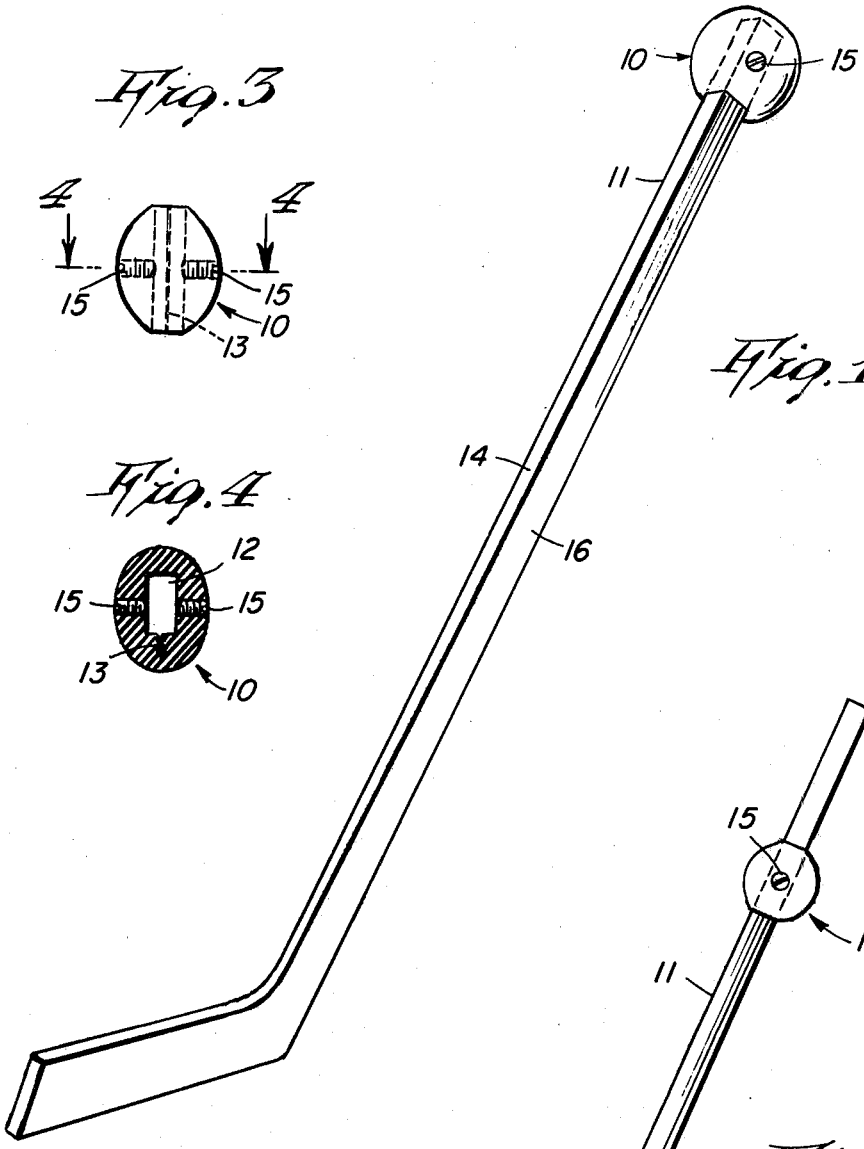
Fig. 1
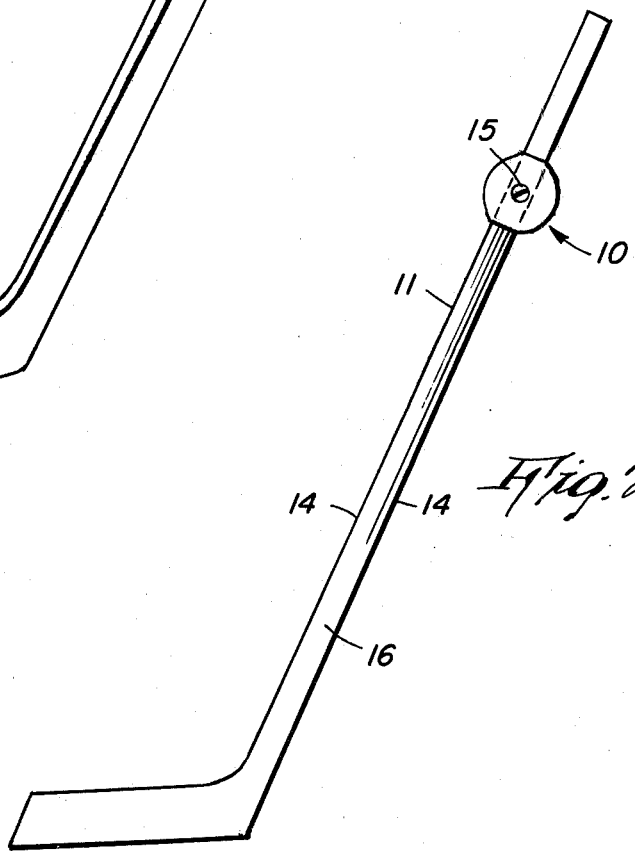
Fig. 2

HOCKEY STICK WITH ADJUSTABLE KNOB

This invention relates generally to hockey sticks. More specifically it relates to hockey stick end buffers.

It is generally well known to those persons who are acquainted with the game of hockey that hockey sticks include a handle portion that is straight so that there is no provision made for firmly grasping the hockey stick in a person's hands and keep the hockey stick from slipping from a person's grip. This is particularly easy to happen especially when a person is wearing gloves or mittens such as is often necessary when playing hockey upon ice out of doors. This situation is of course objectionable and is therefore in want of an improvement.

Accordingly it is a principal object of the present invention to provide a hockey stick that includes a knob upon its handle so that the knob can be more easily grasped in order to prevent the hockey stick slipping out of the person's grip.

Another object of the present invention is to provide a hockey stick knob in which the knob is selectively adjustable along the length of the hockey stick handle so as to suit an individual player.

Still another object of the present invention is to provide a hockey stick knob which can be quickly and easily adjusted and secured along any portion of the hockey stick handle, and which requires no tool other than any flat object such as a coin in order to turn a set screw.

Other objects are to provide a hockey stick knob which is simple in design, inexpensive to manufacuture, rugged in construction, easy to use and efficient in operation.

These and other objects will become readily evident upon a study of the following specification together with the accompanying drawing wherein:

FIG. 1 is a perspective view of a hockey stick showing the knob secured upon its upper end;

FIG. 2 is a side elevation view of a hockey stick with the knob attached along an intermediate portion of the handle;

FIG. 3 is a front elevation view of the knob shown per se;

FIG. 4 is a cross-sectional view of the knob taken along the line 4—4 of FIG. 3.

Referring now to the drawing in detail, the reference numeral 10 represents a hockey stick knob, according to the present invention and which is readily, selectively mountable along a handle 11 of a hockey stick 10.

The knob 10 is of a generally ovaloid or spherical shape and which is made from flexible plastic material. It is of a size so that it can be conveniently grasped in the hand of a player while not being unduly heavy so to unbalance the normal swinging of a hockey stick.

The knob 10 includes a central opening 12 that extends through the knob and which is of generally rectangular cross-sectional configuration in order to conform to the general cross-sectional configuration of the hockey stick handle 11 which is snuggly fitted therein. In order to accommodate variations in sizes of hockey stick handles 11, the central opening 12 therefore additonally includes a crack or slit 13 along one narrow side of the rectangular opening so that the opening 12 is thus enlargable by spreading open of the slit whereby the opening 12 is expandable principably only on its opposite flat sides or longitudinal sides which are positioned adjacent the flat sides of the hockey stick rather than against the opposite end edges 14 thereof. In order to secure the knob in any selected position along the hockey stick handle, a set screw 15 extends through opposite sides of the knob in order to abut against the flat sides 16 of the hockey stick handle. Each of the set screws 15 includes a conventional cross-slot upon its outer end and which is of a size so that it can be turned by an edge of a coin being inserted therein so that a hockey player needs not carry any special tools with him in order to make the adjustment, such adjustment being readily accomplished by a conventional coin such as a penny which is most likely to be obtained in any person's pocket.

As shown in FIG. 2, the knob can be secured along a longitudinal intermediate portion of the hockey stick handle to suit a hockey player who is of shorter stature than a hockey player who would prefer the knob to be mounted upon the end of the handle as shown in FIG. 1.

Thus there is provided a novel hockey stick knob that serves a useful purpose.

While various changes may be made in the detailed construction, it is understood that such changes will be within the spirit and scope of the present invention as is defined by the appended claims.

What I now claim is:

1. An improved hockey stick, comprising in combination, a knob and a hockey stick member consisting of a straight handle which at one end is integral with a straight blade extending angularly respective thereto, said knob being unitary by comprising an undivided, integrated member of generally ovaloid shape and made of flexible plastic material, said hockey stick handle being cross-sectionally rectangular in shape, said knob having a central opening therethrough of similar cross-sectionally rectangular shape, an axially extending slit in a side wall of said opening and extending from an inner surface into the knob wall less than the wall thickness thereof, said opening providing transverse stretching of said knob for frictional fit on said handle, said knob being slideable along said handle, and securable fixedly thereto in a selected position by a pair of set screws on opposite sides of said knob.

* * * * *